United States Patent [19]

Katagiri et al.

[11] Patent Number: 4,673,630

[45] Date of Patent: Jun. 16, 1987

[54] PHOTOCONDUCTIVE FILM AND ELECTROPHOTOGRAPHIC PHOTOSENSITIVE MEMBER CONTAINS AZULENIUM SALT

[75] Inventors: Kazuhara Katagiri, Tama; Yoshihiro Oguchi, Yokohama; Takeshi Ohtake, Fujisawa; Kozo Arao, Tokyo; Makoto Kitahara, Yokohama; Yoshio Takasu, Tama, all of Japan

[73] Assignee: Canon Kabushiki Kaisha, Tokyo, Japan

[21] Appl. No.: 741,878

[22] Filed: Jun. 6, 1985

[30] Foreign Application Priority Data

Jun. 11, 1984 [JP] Japan ..... 59-119411

[51] Int. Cl.[4] ..... G03G 5/06

[52] U.S. Cl. ..... 430/72; 430/75

[58] Field of Search ..... 430/72, 73, 71

[56] References Cited

U.S. PATENT DOCUMENTS 4,548,886 10/1985 Katagiri et al. ..... 430/57 X

*Primary Examiner*—J. David Welsh

*Attorney, Agent, or Firm*—Fitzpatrick, Cella, Harper & Scinto

[57] ABSTRACT

Photoconductive films contain specified azulenium salt compounds. Electrophotographic photosensitive members are provided with a photoconductive film containing at least one of the specified azulenium salt compounds.

19 Claims, No Drawings

PHOTOCONDUCTIVE FILM AND ELECTROPHOTOGRAPHIC PHOTOSENSITIVE MEMBER CONTAINS AZULENIUM SALT

BACKGROUND OF THE INVENTION

1. Field of the Invention

This invention relates to a novel photoconductive film and an electrophotographic photosensitive member of high sensitivity using said photoconductive film.

2. Description of the Prior Art

Heretofore, there have been disclosed pigments and dyes exhibiting photoconductivity in the literature. For example, RCA Review, Vol. 23, pp. 413–419 (1962. 9) discloses photoconductivity of a phthalocyanine pigment, and U.S. Pat. Nos. 3,397,086 and 3,816,118 discloses an electrophotographic photosesitive member employing a phthalocyanine pigment. Further, as an organic semiconductor used in an electrophotographic photosensitive member, there is mentioned, for example, a pyrylium type dye disclosed in U.S. Pat. Nos. 4,315,983 and 4,327,169 and "Research Disclosure" 20517 (1981. 5), a methine squaric acid dye disclosed in U.S. Pat. No. 3,824,099, a disazo pigment disclosed in U.S. Pat. Nos. 3,898,084 and 4,251,613, or the like.

Such organic semiconductors can be prepared easily as compared with inorganic semiconductors, and also can be prepared as compounds having photoconductivity sensitive to a light of a desired wavelength range. Electrophotographic photosensitive members constituted of such an organic semiconductor film formed on a conductive substrate have advantageous good color sensitivity. However, there are only a few organic semiconductors having practically good sensitivity and durability. In particular, as the result of recent development of low power semiconductor laser, there are actively developed organic semiconductors of a high sensitivity characteristics as to long wavelength lights such as those of 700 nm or more, but compounds having a large light absorbing coefficient as to long wavelength lights are, in general, thermally unstable and are liable to be decomposed due to even a slight temperature rise. Therefore, electrophotographic photosensitive members sensitive to infrared ray are practically difficult to be produced.

SUMMARY OF THE INVENTION

An object of the present invention is to provide a novel organic semiconductor.

Another object of the present invention is to provide a novel organic semiconductor film.

A further object of the present invention is to provide an electrophotographic photosensitive member employing the novel organic semiconductor film.

Still another object of the present invention is to provide an electrophotographic photosensitive member suitable for an electrophotographic copying machine.

A still farther object of the present invention is to provide an electrophotographic photosensitive member suitable for a laser-beam-scanning electrophotographic printer.

Still another object of the present invention is to provide an electrophotographic photosensitive member highly sensitive to rays of long wavelengths.

According to one aspect of the present invention, there is provided a photoconductive film which comprises the azulenium salt compound represented by the formula (I), (II) or (III) as shown below;

(I)

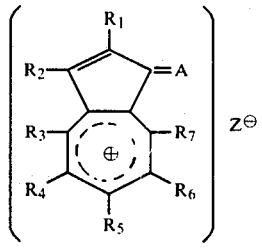

(II)

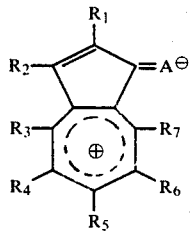

(III)

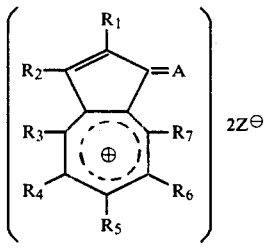

wherein each of $R_1$, $R_2$, $R_3$, $R_4$, $R_5$, $R_6$, and $R_7$ is hydrogen, halogen, or an organic monovalent residue, and at least one of the combinations ($R_1$ and $R_2$), ($R_2$ and $R_3$), ($R_3$ and $R_4$), ($R_4$ and $R_5$), ($R_5$ and $R_6$), and ($R_6$ and $R_7$) may form a substituted or unsubstituted heterocyclic ring or aliphatic ring. At least one of the combinations ($R_1$ and $R_2$), ($R_3$ and $R_4$), ($R_4$ and $R_5$), ($R_5$ and $R_6$), and ($R_6$ and $R_7$) may form a substituted or unsubstituted aromatic ring; A is an organic divalent residue linked with a double bond; $Z^{\ominus}$ is an anionic residue.

According to another aspect of the present invention, there is provided an electrophotographic photosensitive member which comprises an electroconductive substrate and a photoconductive film comprising the azulenium salt compound represented by the formula (I), (II), or (III) as shown below;

(I)

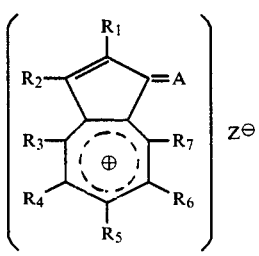

-continued (II)

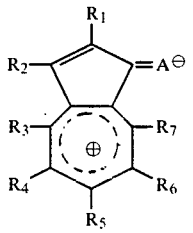

(III)

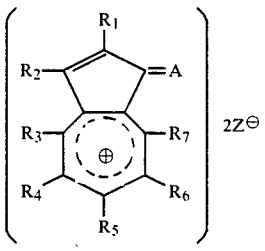

wherein each of $R_1$, $R_2$, $R_3$, $R_4$, $R_5$, $R_6$, and $R_7$ is hydrogen, halogen, or an organic monovalent residue, and at least one of the combinations ($R_1$ and $R_2$), ($R_2$ and $R_3$), ($R_3$ and $R_4$), ($R_4$ and $R_5$), ($R_5$ and $R_6$), and ($R_6$ and $R_7$) may form a substituted or unsubstituted heterocyclic ring or aliphatic ring. At least one of the combinations ($R_1$ and $R_2$), ($R_3$ and $R_4$), ($R_4$ and $R_5$), ($R_5$ and $R_6$), and ($R_6$ and $R_7$) may form a substituted or unsubstituted aromatic ring; A is an organic divalent residue linked with a double bond; $Z^{\ominus}$ is an anionic residue.

DETAILED DESCRIPTION OF THE PREFERRED EMBODIMENTS

In the general formula (I), (II) or (III) of embodiments of the present invention, at least one of the combinations of $R_1$–$R_2$, $R_2$–$R_3$, $R_3$–$R_4$, $R_4$–$R_5$, $R_5$–$R_6$, and $R_6$–$R_7$ can form a substituted or unsubstituted heterocyclic ring or ring formed by aliphatic chains. Each of $R_1$ to $R_7$ but in contributing to form said ring represents hydrogen, halogen (chlorine, bromine or iodine), or a monovalent organic residue. The heterocycle formed are furan-, benzofuran-, pyrrole-, thiophene-, pyridine-, quinoline-, and thiazole-ring, and the aliphatic chains are dimethylene-, trimethylene- and tetramethylene-group.

These heterocycles or rings formed with aliphatic chains can be substituted with halogen (chlorine, bromine and iodine), alkyl groups (e.g. methyl, ethyl, propyl, and butyl), alkoxy groups (e.g. methoxy, ethoxy, and butoxy), amino groups and the like. While the monovalent residue can be selected from a wide variety of radicals, preferred ones thereof are alkyl groups (e.g. methyl, ethyl, n-propyl, isopropyl, n-butyl, t-butyl, n-amyl, n-hexyl, n-octyl, 2-ethylhexyl, and t-octyl, alkoxy groups (e.g. methoxy, ethoxy, propoxy, and butoxy) substituted or unsubstituted aryl groups (e.g. phenyl, tolyl, xylyl, ethylphenyl, methoxyphenyl, ethoxyphenyl, chlorophenyl, nitrophenyl, dimethylaminophenyl, α-naphthyl, and β-naphthyl), substituted or unsubstituted heterocyclic groups (e.g. pyridyl, quinolyl, carbazolyl, furyl, thienyl and pyrazolyl), substituted or unsubstituted aralkyl groups (e.g. benzyl, 2-phenylethyl, 2-phenyl-1-methylethyl, bromobenzyl, 2-bromophenylethyl, methylbenzyl, methoxybenzyl, and nitrobenzyl), acyl groups (e.g. acetyl, propionyl, butyryl, valeryl, benzoyl, toluoyl, naphthoyl, phthaloyl, and furoyl), substituted or unsubstituted amino groups (e.g. amino, dimethylamino, diethylamino, dipropylamino, acetylamino, and benzoylamino), substituted or unsubstituted styryl groups (e.g. styryl, dimethylaminostyryl, diethylaminostyryl, dipropylaminostyryl, methoxystyryl, ethoxystyryl, and methylstyryl), nitro, hydroxyl, mercapto, thioether, carboxyl, carboxylate carboxamide, cyano and substituted or unsubstituted arylazo groups (e.g. phenylazo, α-naphthylazo, β-naphthylazo, dimethylaminophenylazo, chlorophenylazo, nitrophenylazo, methoxyphenylazo, and tolylazo). At least one of the combinations of $R_1$–$R_2$, $R_3$–$R_4$, $R_4$–$R_5$, $R_5$–$R_6$, and $R_6$–$R_7$, may or may not form a substituted or unsubstituted aromatic ring (e.g. benzene, naphthalene, chlorobenzene, bromobenzene, methylbenzene, ethylbenzene, methoxybenzene, or ethoxybenzene).

A represents a bivalent organic residue linked by a double bond. The embodiments of the present invention containing said A can be represented, for example, by the following general formulae (1)–(11): wherein $Q^{\oplus}$ represents the following azulenium skeleton, and the right-hand moieties, excluding $Q^{\oplus}$, represents A.

Azulenium skeleton ($Q^{\oplus}$):

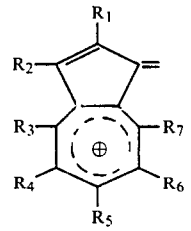

General formula (1):

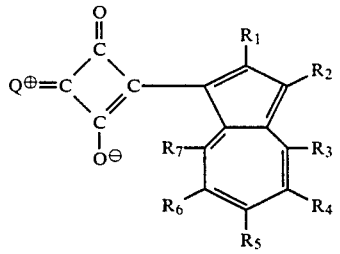

$R_1$ to $R_7$ in this formula are as defined above.

General formula (2):

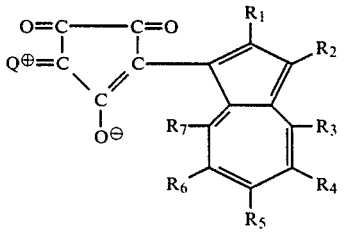

$R_1$ to $R_7$ in this formula are as defined above.

General formula (3):

-continued

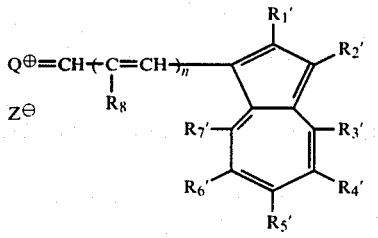

At least one the combinations of $R_1'$–$R_2'$, $R_2'$–$R_3'$, $R_3'$–$R_4'$, $R_4'$–$R_5'$, $R_5'$–$R_6'$, and $R_6'$–$R_7'$ in this formula can form a substituted or unsubstituted heterocycle or ring formed with aliphatic chains. Each of $R_1$ to $R_7$ but in contributing to form said ring represents hydrogen, halogen (e.g. chlorine, bromine or iodine) or a monovalent organic residue. The heterocycles formed are, for example, furan-, benzofuran-, pyrrole-, thiophene-, pyridine-, quinoline-, thiazole-ring and the like, and the aliphatic chains are, for example, dimethylene-, trimethylene- and tetramethylene-group.

The heterocycle or ring formed with aliphatic chains can be substituted with halogens (chlorine, bromine and iodine), alkyl groups (e.g. methyl, ethyl, propyl and butyl), and amino group.

The organic monovalent residue can be selected from a variety of radicals. Preferred examples of the organic monovalent residues are alkyl groups (e.g. methyl, ethyl, n-propyl, isopropyl, n-butyl, t-butyl, n-amyl, n-hexyl, n-octyl, 2-ethylhexyl, and t-octyl), alkoxy groups (e.g. methoxy, ethoxy, propoxy, and butoxy), substituted or unsubstituted aryl groups (e.g. phenyl, tolyl, xylyl, ethylphenyl, methoxyphenyl, ethoxyphenyl, chlorophenyl, nitrophenyl, dimethylaminophenyl, α-naphthyl, and β-naphthyl), substituted or unsubstituted heterocyclic groups (e.g. pyridyl, quinolyl, carbazolyl, furyl, thienyl and pyrazolyl), substituted or unsubstituted aralkyl groups (e.g. benzyl, 2-phenylethyl, 2-phenyl-1-methylethyl, bromobenzyl, 2-bromophenylethyl, methylbenzyl, methoxybenzyl, and nitrobenzyl), acyl groups (e.g. acetyl, propionyl, butyryl, valeryl, benzoyl, toluoyl, naphthoyl, phthaloyl, and furoyl), substituted or unsubstituted amino groups (e.g. amino, dimethylamino, diethylamino, dipropylamino, acetylamino, and benzoylamino), substituted or unsubstituted styryl groups (e.g. styryl, dimethylaminostyryl, diethylaminostyryl, dipropylaminostyryl, methoxystyryl, ethoxystyryl, and methylstyryl), nitro, hydroxyl, mercapto, thioether, carboxyl, carboxylate, carboxamide, cyano, and substituted or unsubstituted arylazo groups (e.g. phenylazo, α-naphthylazo, β-naphthylazo, dimethylaminophenylazo, chlorophenylazo, nitrophenylazo, methoxyphenylazo, and tolylazo). At least one of the combinations of $R_1'$–$R_2'$, $R_3'$–$R_4'$, $R_4'$–$R_5'$. $R_5'$–$R_6'$, and $R_6'$–$R_7'$ may or may not form a substituted or unsubstituted aromatic ring (e.g. benzene, naphthalene, chlorobenzene, bromobenzene, methylbenzene, ethylbenzene, methoxybenzene, or ethoxybenzene). The relationship of the azulenium skeleton represented by $Q^{\oplus}$ to the right-hand azulene skeleton in said formula (3) can be symmetric or asymmetric. $Z^{\ominus}$ represents an anionic residue; $R_8$ represents hydrogen, nitro, cyano, or alkyl (e.g. methyl, ethyl, propyl, or butyl), or aryl (e.g. phenyl, tolyl, or xylyl); and n represents an integer of 0, 1, or 2.

General formula (4):

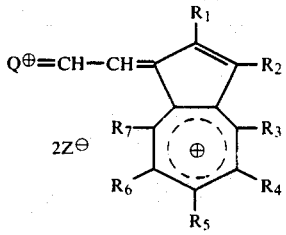

$R_1$ to $R_7$ and $Z^{\ominus}$ in this formula are as defined above.

General formula (5):

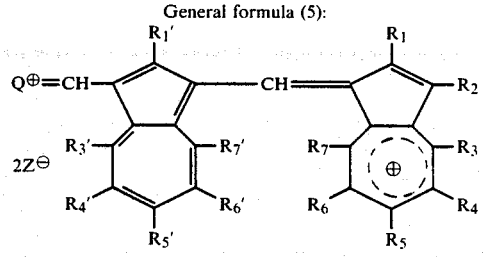

In this formula, $R_1$ to $R_7$, $R_1'$, $R_3'$ to $R_7'$, and $Z^{\ominus}$ are as defined above.

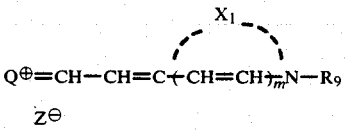

In this formula; $X_1$ represents a non-metal-atomic group necessary to complete a nitrogen-containing heterocyclic ring (e.g. pyridine-, thiazole-, benzothiazole-, naphthothiazole-, oxazole-, benzoxazole-, naphthoxazole-, imidazole-, benzimidazole-, naphthoimidazole-, 2-quinoline-, 4-quinoline-, isoquinoline-, or indole-ring). These heterocyclic rings may be substituted by halogen (e.g. chlorine, bromine, and iodine), alkyl (e.g. methyl, ethyl, propyl, and butyl), and aryl (e.g. phenyl, tolyl, and xylyl). $R_9$ represents alkyl (e.g. methyl, ethyl, propyl, or butyl), substituted alkyl (e.g. 2-hydroxyethyl, 2-methoxyethyl, 2-ethoxyethyl, 3-hydroxypropyl, 3-methoxypropyl, 3-ethoxypropyl, 3-chloropropyl, 3-bromopropyl, or 3-carboxypropyl), cycloalkyl (e.g. cyclohexyl or cyclopropyl), allyl, aralkyl (e.g. benzyl, 2-phenylethyl, 3-phenylpropyl, 4-phenylbutyl, α-naphthylmethyl, or β-naphthylmethyl), substituted aralkyl (e.g. methylbenzyl, ethylbenzyl, dimethylbenzyl, trimethylbenzyl, chlorobenzyl, or bromobenzyl), aryl (e.g. phenyl, tolyl, xylyl, α-naphthyl, or β-naphthyl), or substituted aryl (e.g. chlorophenyl, dichlorophenyl, trichlorophenyl, ethylphenyl, methoxyphenyl, dimethoxyphenyl, aminophenyl, nitrophenyl, or hydroxyphenyl). $Z^{\ominus}$ represents an anionic residue; and m represents an integer of 0 or 1.

General formula (7):

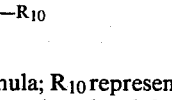

In this formula; $R_{10}$ represents substituted or unsubstituted aryl (e.g. phenyl, tolyl, xylyl, biphenyl, α-naphthyl, β-naphthyl, anthryl, pyrenyl, methoxyphenyl, dimethoxyphenyl, trimethoxyphenyl, ethoxyphenyl, diethoxyphenyl, chlorophenyl, dichlorophenyl, trichlorophenyl, bromophenyl, dibromophenyl, tribromophenyl, ethylphenyl, diethylphenyl, nitrophenyl, aminophenyl, dimethylaminophenyl, diethylaminophenyl, dibenzylaminophenyl, dipropylaminophenyl, morpholinophenyl, piperidylphenyl, piperazinophenyl, diphenylaminophenyl, acetylaminophenyl, benzoylaminophenyl, acetylphenyl, benzoylphenyl, or cyanophenyl), and $Z^{\ominus}$ represents an anionic residue.

General formula (8):

$$Q^{\oplus}=CH-R_{11}$$

$$Z^{\ominus}$$

In this formula; $R_{11}$ represents a monovalent heterocyclic residue derived from heterocyclic ring (e.g. furan, thiophene, benzofuran, thionaphthene, dibenzofuran, carbazole, phenothiazine, phenoxazine, or pyridine), and $Z^{\oplus}$ represents an anionic residue.

$$Q^{\oplus}=CH-CH=C-R_{10} \qquad \text{General formula (9)}$$

$$Z^{\ominus} \qquad R_{12}$$

In this formula; $R_{12}$ represents hydrogen, alkyl (e.g. methyl, ethyl, propyl, or butyl), or substituted or unsubstituted aryl (e.g. phenyl, tolyl, xylyl, biphenyl, ethylphenyl, chlorophenyl, methoxyphenyl, ethoxyphenyl, nitrophenyl, aminophenyl, dimethylaminophenyl, diethylaminophenyl, acetylaminophenyl, α-naphthyl, β-naphthyl, anthryl, or pyrenyl), and $R_{10}$ and $Z^{\ominus}$ are as defined above.

General formula (10):

$$Q^{\oplus}=CH-C\equiv C-R_{10}$$

$$Z^{\ominus}$$

In this formula, $R_{10}$ and $Z^{\ominus}$ are as defined above.

General formula (11)

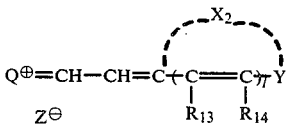

In this formula; $X_2$ represents an atomic group necessary to complete pyrane, thiapyrane, selenapyrane, benzopyrane, benzothiapyrane, benzoselenapyrane, naphthopyrane, naphthothiapyrane, or naphthoselenapyrane ring substituted or unsubstituted; l represents an integer of 0 or 1; Y represents sulfur, oxygen, or selenium; $R_{13}$ and $R_{14}$ each represent hydrogen, alkyl (e.g. methyl, ethyl, propyl, or butyl), alkoxy (e.g. methoxy, ethoxy, propoxy, or butoxy), substituted or unsubstituted aryl (e.g. phenyl, tolyl, xylyl, chlorophenyl, biphenyl, or methoxyphenyl), substituted or unsubstituted styryl (e.g. styryl, p-methylstyryl, o-chlorostyryl, or p-methoxystyryl), substituted or unsubstituted 4-phenyl-1,3-butadienyl (e.g. 4-phenyl-1,3-butadienyl or 4-(p-methylphenyl)1,3-butadienyl), or a substituted or unsubstituted heterocyclic group (e.g. quinolyl, pyridyl, carbazolyl, or furyl); and $Z^{\ominus}$ represents an anionic residue.

Examples of $Z^{\ominus}$ in the above general formulae (1)–(11) are perchlorate, fluoroborate, sulfoacetate, iodide, chloride, bromide, p-toluenesulfonate, alkylsulfonates, alkyldisulfonates, benzenedisulfonate, halosulfonates, picrate, tetracyanoethylene anionic moiety, and tetracyanoquinodimethane anionic moiety.

Examples of the azulenium compound used in this invention are enumerated below.

Examples of compound represented by the above-mentioned general formula (1)

(1)

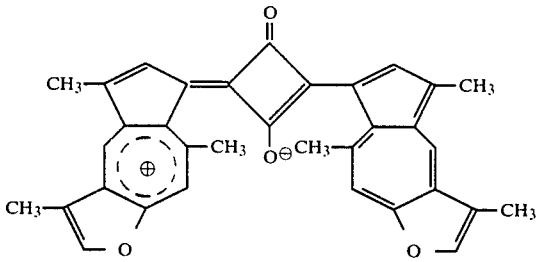

(2)

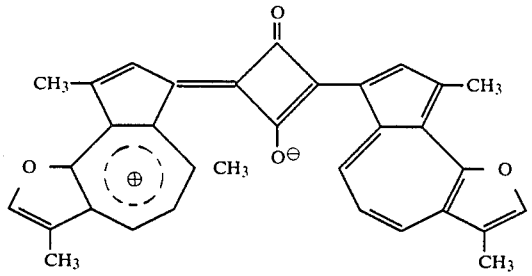

(3)

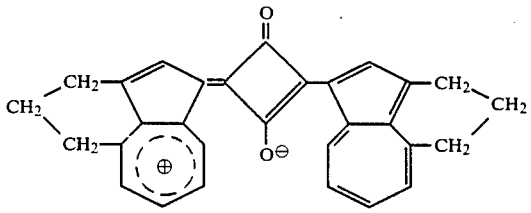

(4)

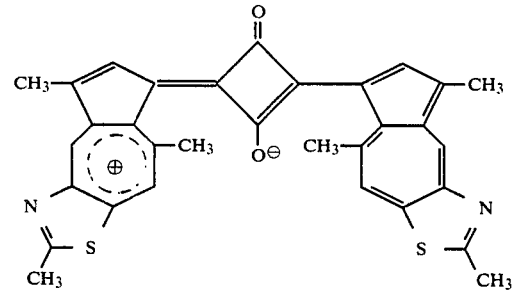

(5)

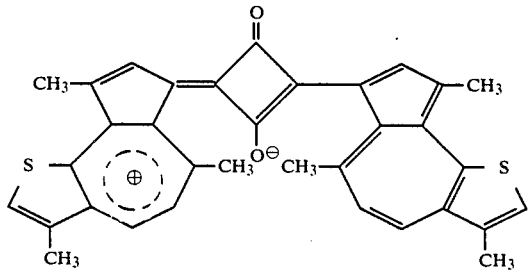

Examples of compound represented by the above-mentioned general formula (2)

(6)
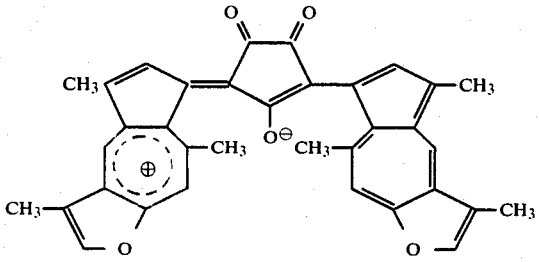
(7)
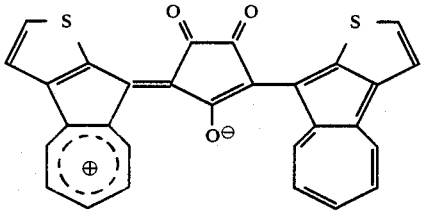
(8)
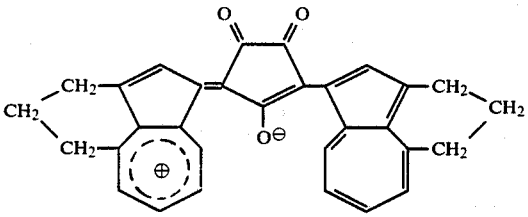
Examples of compound represented by the above-mentioned general formula (3)
(14)
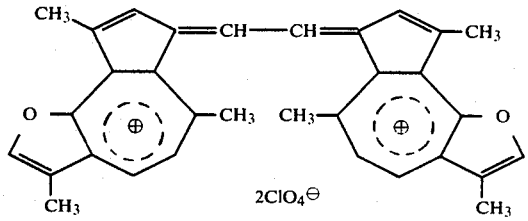
(15)
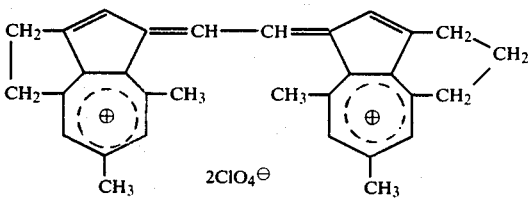
Examples of compound represented by the above-mentioned general formula (5)
(16)
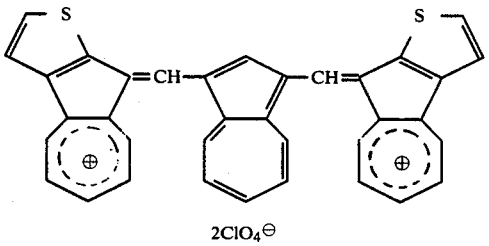
(9)
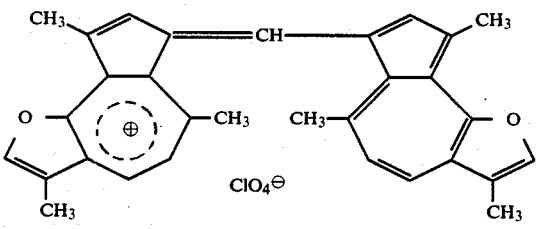
(10)
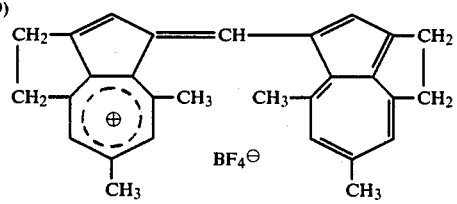
(11)
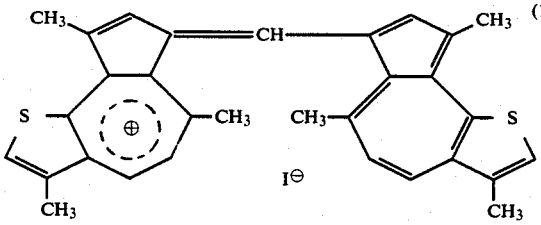
(12)
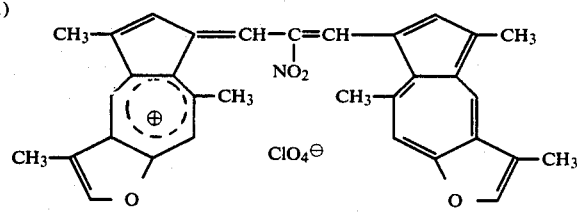
(13)
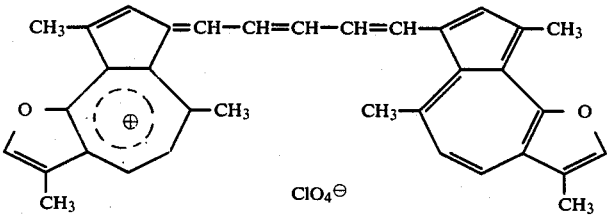
Examples of compound represented by the above-mentioned general formula (4)

-continued
(17)
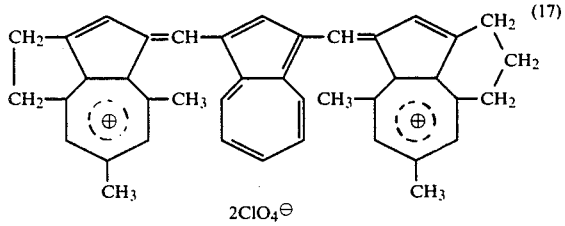
(18)
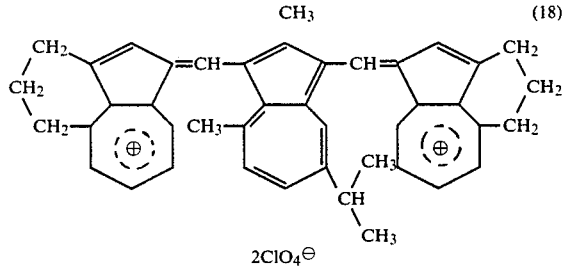
Examples of compound represented by the above-mentioned general formula (6)
(19)
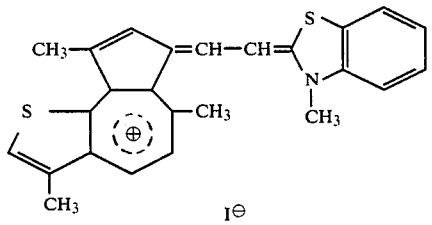
(20)
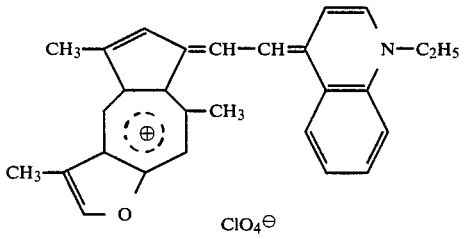
(21)
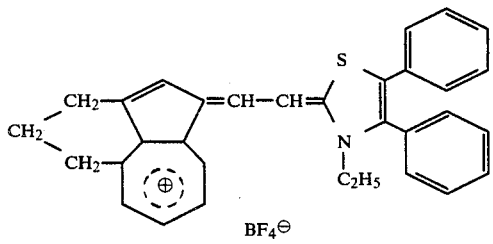
(22)
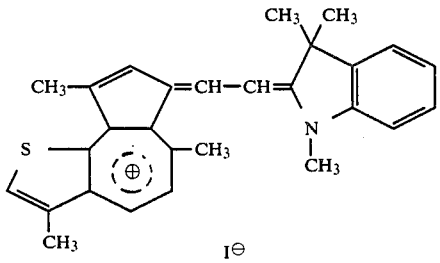
Examples of compound represented by the above-mentioned general formula (7)
(23)
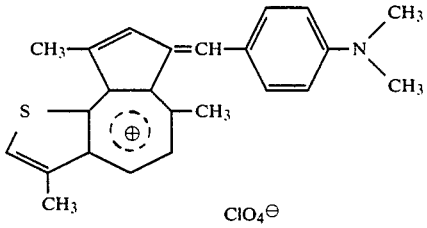
(24)
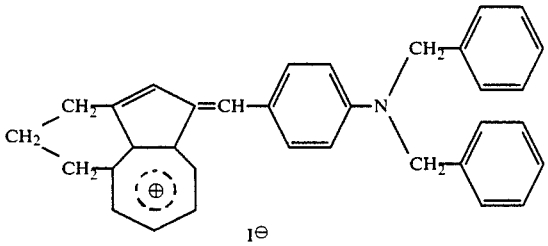
(25)
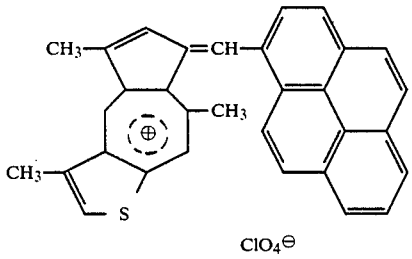
(26)
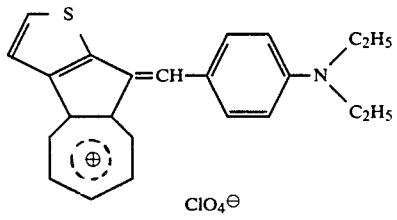
(27)
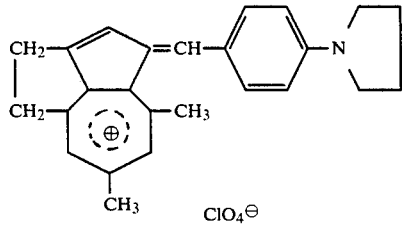

-continued
(28)
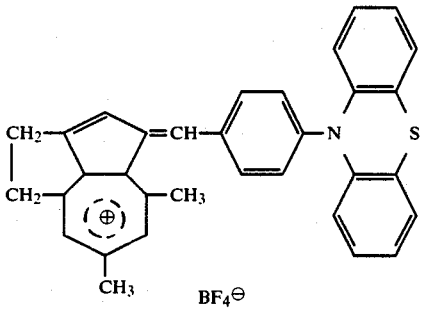
Examples of compound represented by the above-mentioned general formula (8)
(29)
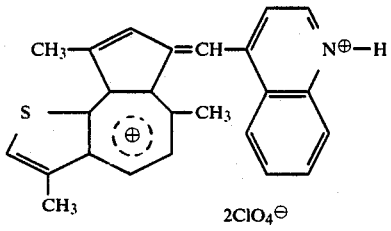
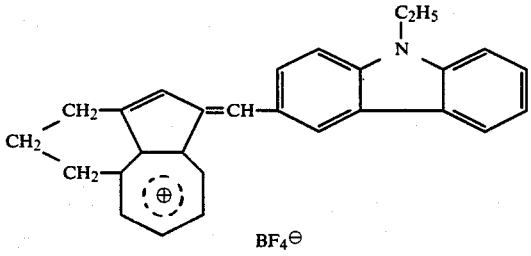
(31)
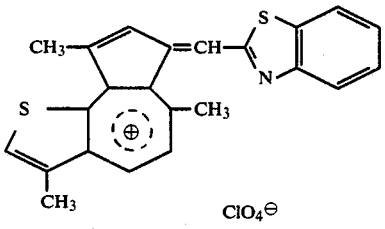
(32)
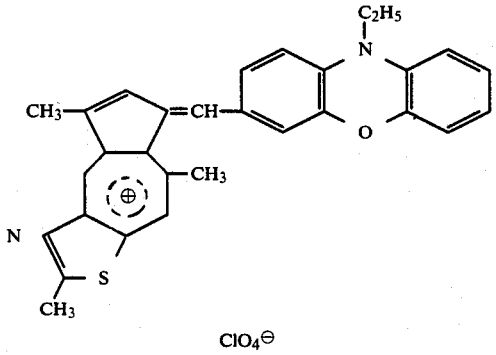
Examples of compound represented by the above-mentioned general formula (9)
(33)
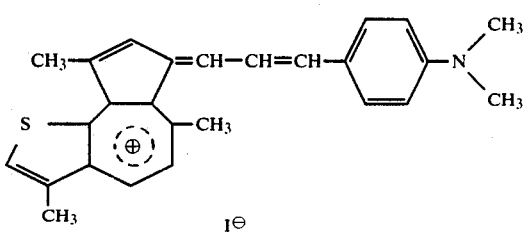
(34)
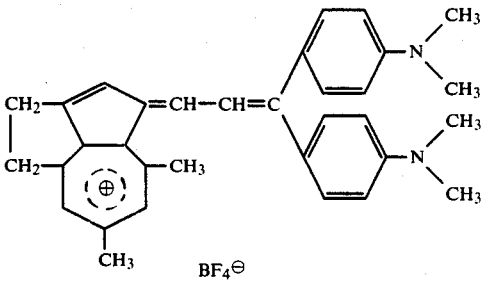
(35)
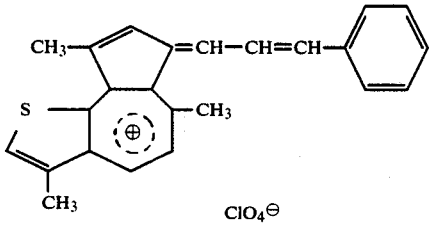
(36)
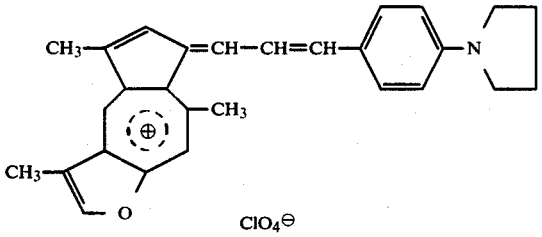
(37)
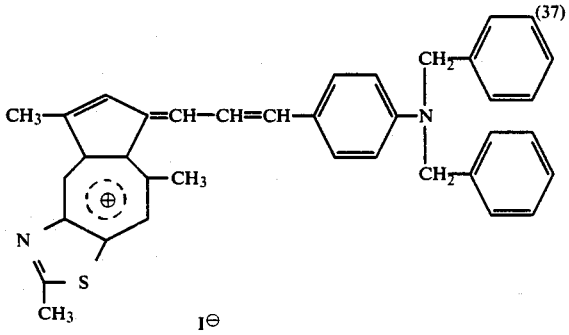
Examples of compound represented by the above-mentioned general formula (10)

(38)

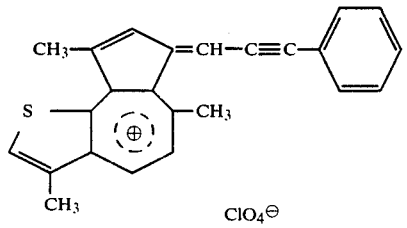

(39)

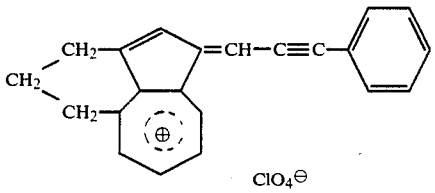

(40)

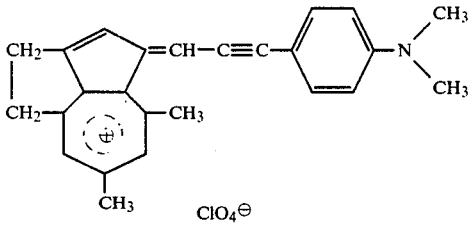

(41)

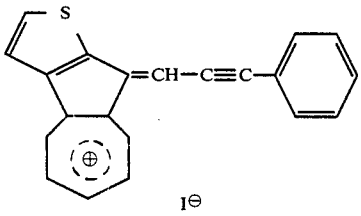

Examples of compound represented by the above-mentioned general formula (11)

(42)

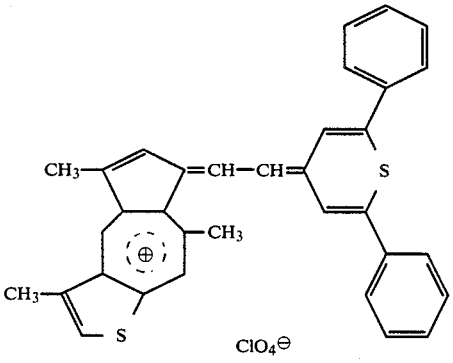

-continued (43)

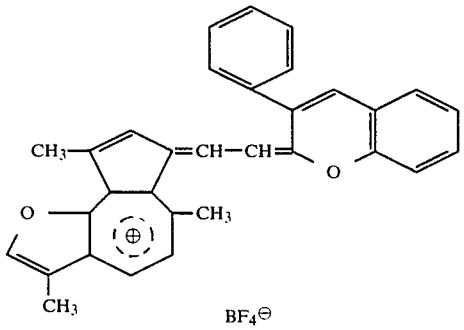

(44)

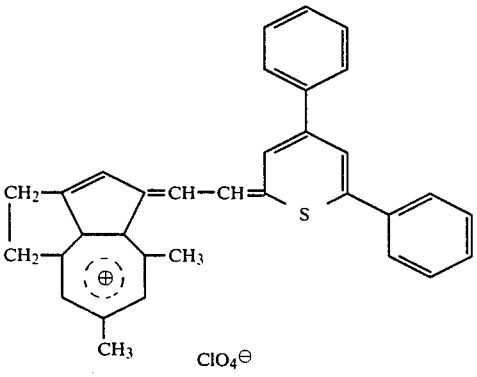

(45)

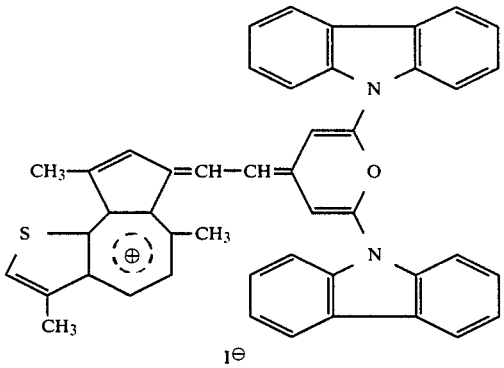

The compounds having the general formula (1) or (2) are readily prepared by allowing azulene compounds to react with squaric acid or croconic acid in an appropreate solvent as described in Angew. Chem., Vol. 78 (1966), No. 20, page 937.

The compounds having the general formula (3) wherein n=0 are prepared by heating a solution of 1-formylazulene compounds and azulene compounds in an appropreate solvent in the presence of strong acids as described in J. Chem. Soc. (1960), page 501, by mixing 1-ethoxymethyleneazulenium salt compounds with azulene compounds in an appropreate solvent as described in ibid. (1961), pages 1724–1730, or by heating a solution of 2-hydroxymethylenecyclohexanone and azulene compounds in an appropreate solvent in the presence of strong acids as described in ibid. (1961), page 359. Also, the compounds having the general formula (3) wherein n=1 or 2 are prepared by mixing azulene compounds with malondialdehydes or glutacondialdehydes in an appropreate solvent in the presence of strong acids as described in J. Chem. Soc. (1961), pages 3591–3592.

The compounds having the general formula (4) are readily prepared by heating azulene compounds and glyoxal in the presence of strong acids in an appropreate solvent as described in J. Chem. Soc. (1961), page 3588.

The compounds having the general formula (5) are prepared by heating 1,3-diformylazulen compounds and azulen compounds in the presence of strong acids in an appropreate solvent as described in J. Chem. Soc. (1960), page 501.

The compounds having the general formula (6) are prepared by heating 1-formylazulene compounds and heterocyclic quaternary ammonium salt compounds having active methyl groups in an appropreate solvent.

The compounds having the general formula (7), (8), (9) or (10) are prepared by mixing azulen compounds with corresponding aldehyde compounds in the presence of strong acids in an appropreate solvent as described in J. Chem. Soc. (1958), pages 1110–1117, ibid. (1960), pages 494–501, and ibid. (1961), pages 3579–3593.

The compounds having the general formula (11) are prepared by allowing 1-formylazulene compounds to react in an appropreate solvent with the compounds having a general formula (12):

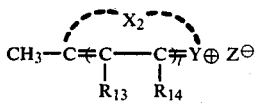

wherein $X_2$, Y, $R_{13}$, $R_{14}$, $Z^{\ominus}$ and l are as previouly defined.

As the reaction solvent, there may be used alcohols such as ethanol, butanol, benzyl alcohol and the like; nitriles such as acetonitrile, propionitrile and the like; organic carboxylic acids such as acetic anhydride and the like; acid anhydrides such as acetic anhydride and the like; alicyclic ethers such as dioxane, tetrahydrofuran and the like. Also, aromatic hydrocarbons such as benzen and the like may be used by mixed with butanol, benzyl alcohol or the like. The temperature during reaction may be selected from a range of room temperature to the boiling point.

Films containing the above azulenium compounds exhibit photoconductivity and accordingly can be used for the following photoconductive layers of electrophotographic photosensitive members.

In this invention, electrophotographic photosensitive members can be prepared by forming layers of the above azulenium salt compounds on electrically conductive substrates by vacuum deposition or application of a solution or dispersion thereof in a suitable binder.

In preferred embodiments of this invention, the above photoconductive films can be applied as the charge generation layer of an electrophotographic photosensitive member the photosensitive layer of which is functionally divided into a charge generation layer and a charge transport layer, respectively.

The charge generation layer is desired to contain the above photconductive compound as much as possible for the purpose of affording sufficient absorptivity, i.e., absorbing most of the incident light to generate a great number of charge carriers. Additionally, the charge generation layer is desirably as thin as 5μ or less, preferably 0.01–1μ, for the purpose of effective injection of the generated charge carriers into the charge transport layer without substantial deactivation of the carriers due to the recombination or capture (trapping).

The charge generation layer can be formed by applying a solution or dispersion of the above azulenium compound in a suitable binder on a substrate or by forming a deposited film of the compound using a vacuum deposition apparatus. Suitable binders can be selected from a wide variety of insulating resins and from organic photoconductive polymers such as poly(N-vinylcarbazole), polyvinylanthracene, polyvinylpyrene, and the like. Preferred examples of the binder are insulating resins such as poly(vinyl butyral), polyarylates (including a condensation polymer of bisphenol A and phthalic acid), polycarbonates, polyesters, phenoxy resins, poly(vinyl acetate), acrylic resins, polyacrylamides, polyamides, polyvinylpyridine, cellulosic resins, urethane resins, epoxy resins, casein, poly(vinyl alcohol), and polyvinylpyrrolidone. Contents of the binder resin in the charge generation layer are up to 80%, preferably up to 40%, by weight.

Solvents suitable for these resins vary depending upon the kind of resin and are desired to be selected from those not dissolving the charge transport layer or undercoating layer. As examples of the solvents may be cited alcohols such as methanol, ethanol and isopropanol; ketones such as acetone, methyl ethyl ketone and cyclohexanone; amides such as N,N-dimethylformamide and N,N-dimethylacetamide; sulfoxides such as dimethylsulfoxide; ethers such as tetrahydrofuran, dioxane and ethylene glycol monomethyl ether; esters such as methyl acetate and ethyl acetate; halogenated aliphatic hydrocarbons such as chloroform, methylene chloride, dichloroethylene, carbon tetrachloride and trichloroethylene; and aromatics such as benzene, toluene, xylene, ligroin, monochlorobenzene and dichlorobenzene.

The coating can be accomplished by dip coating, spray coating, spinner coating, bead coating, Meyer bar coating, blade coating, roller coating, curtain coating and the like. The coating film is dried preferably by heating after the set to touch at room temperature. The heat drying can be performed at 30°–200° C. for 5 minutes to 2 hours with or without blowing air.

The charge transport layer, being electrically in communication with the above-mentioned charge generation layer, has a function of receiving charge carriers from the charge generation layer in an electric field and a function of transporting these charge carriers to its surface. The charge transport layer may be laminated either on the upper side or the lower side (substrate side) of the charge generation layer, but preferably on the upper side.

A material transporting charge carriers in the charge transport layer (hereinafter, simply referred to as "charge-transporting material") is desired to be virtually insensitive to electromagnetic waves to which the charge generation layer is sensitive. The electromagnetic waves herein referred to mean rays of light in a broad sense including γ-rays, X-rays, ultraviolet rays, visible rays, near infrared rays, infrared rays, far infrared rays, etc.

The charge-transporting materials are classified into electron-transporting materials and hole-transporting materials. Electron-transporting materials utilizable in this invention include electron attractive materials, e.g. chloranyl, bromanyl, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, and 2,4,8-trinitrothioxanthone, and their polymeric materials.

Hole-transporting materials utilizable include pyrene, N-ethylcarbazone, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine; hydrazones such as p-diethylaminobenzaldehyde-N,N-diphenylhydrazone, p-diethylaminobenzaldehyde-N-α-naphthyl-N-phenylhydrazone, pyrrolidinylbenzaldehyde-N,N-diphenylhydrazone, 1,3,3-trimethylindolenine-ω-aldehyde-N,N-diphenylhydrazone, and p-diethylaminobenzaldehyde-3-methylbenzthiazolinone-2-hydrazone; 2,5-bis(p-diethylaminophenyl)-1,3,4-oxadiazole; pyrazolines such as 1-phenyl-3-(p-diethylaminostyryl)-5-(p-diethylaminophenyl)pyrazoline, 1-[quinolyl (2)]-3-(p-diethylaminostyryl)-5-(p-diethylaminophenyl)pyrazoline, 1-[pyridyl (2)]-3-(p-diethylaminostyryl)-5-(p-diethylaminophenyl)pyrazoline, 1-[6-methoxypyridyl (2)]-3-(p-diethylaminostyryl)-5-(p-diethylaminophenyl)pyrazoline, 1-[pyridyl (3)]-3-(p-diethylaminostyryl)-5-(p-diethylaminophenyl)pyrazoline, 1-[lepidyl (2)]-3-(p-diethylaminostyryl)-5-(p-diethylaminophenyl)pyrazoline, 1-[pyridyl (2)]-3-(p-diethylaminostyryl)-4-methyl-5-(p-diethylaminophenyl)pyrazoline, 1-[pyridyl (2)]-3-(α-methyl-p-diethylaminostyryl)-5-(p-diethylaminophenyl)-pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline, and spiropyrazoline; oxazole compounds such as 2-(p-diethylaminostyryl)-6-diethylaminobenzoxazole and 2-(p-diethylaminophenyl)-4-(p-dimethylaminophenyl)-5-(2-chlorophenyl)oxazole; thiazole compounds such as 2-(p-diethylaminostyryl)-6-diethylaminobenzothiazole; triarylmethane compounds such as bis(4-diethylamino-2-methylphenyl)-phenylmethane; polyarylalkanes such as 1,1-bis(4-N,N-diethylamino-2-methylphenyl)heptane and 1,1,2,2-tetrakis(4-N,N-dimethylamino-2-methylphenyl)-ethane; triphenylamine, poly(N-vinylcarbazole), polyvinylpyrene, polyvinylanthracene, polyvinylacridine, poly(9-vinylphenylanthracene), pyrene-formaldehyde resin, and ethylcarbazole-formaldehyde resin.

Besides these organic charge-transporting materials, such inorganic materials can also be used as selenium, selenium-tellurium, amorphous silicon, and cadmium sulfide.

These charge-transporting materials can be used singly or in combination of two or more.

When the charge-transporting material employed has no film-forming ability, its coating film can be formed by mixing with a suitable binder. Such binders are insulating resins including, for example, acrylic resins, polyarylates, polyesters, polycarbonates, polystyrene, acrylonitrile-styrene copolymer, acrylonitrile-butadiene copolymer, poly(vinyl butyral), poly(vinyl formal), polysulfone, polyacrylamides, polyamides, and chlorinated rubber; and organic photoconductive polymers including, for example, poly(N-vinylcarbazole), polyvinylanthracene, and polyvinylpyrene.

The charge transport layer cannot be made thicker than necessary because the possible charge-carrier transport distance is limited. Its thickness ranges generally from 5 to 30μ, preferably from 8 to 20μ. For forming the charge transport layer by coating, coating methods as cited above can be applied.

The photosensitive layer having a laminate structure comprising such charge generation and charge transport layers as stated above is formed on a substrate having a conductive layer. The substrates having a conductive layer include; sheets or films having conductivity in themselves, such as aluminium, aluminum alloys, copper, zinc, stainless steel, vanadium, molybdenum, chrominium, titanium, nickel, indium, gold, and platinum; those of plastics [e.g. polyethylene, polypropylene, poly(vinyl chloride), poly(ethylene terephthalate), acrylic resins, polyfluoroethylene] covered with a film formed by vacuum deposition of aluminum, aluminum alloy, indium oxide, tin oxide, indium oxide-tin oxide alloy, or the like; those of plastics coated with dispersion of conductive particles (e.g. carbon black or silver particles) in a suitable binder; those of plastics and paper impregnated with conductive particles; and those of conductive polymers.

An undercoating layer having a barrier function and a bonding function can be laid between the conductive layer and the photosensitive layer. The undercoating layer can be formed from casein, poly(vinyl alcohol), nitrocellulose, ethylene-acrylic acid copolymer, polyamides (e.g. nylon 6, nylon 66, nylon 610, nylon copolymer, or alkoxymethylated nylon), polyurethanes, gelatin, aluminum oxide, or the like.

Thickness of the undercoating layer is desirably 0.1–5μ, preferably 0.5–3μ.

When using a photosensitive member comprising a conductive layer, charge generation layer, and charge transport layer laminated in this order, it is necessary to provide positive charge to the surface of the charge transport layer if the this layer is formed from an electron-transporting material. On image exposure of the photosensitive member after the positive charging, electrons generated in the charge generation layer, in the exposed area, are injected into the charge transport layer, then arrive at the surface, and neutralize the positive charges, thus decaying the surface potential and producing an electrostatic contrast to the unexposed area. The thus produced electrostatic latent images, on development with a negative-working toner, turn into visible images. The toner images can be fixed directly or after being transferred to a transfer recording medium such as paper or a plastic film.

It is also possible that the electrostatic latent images on the photosensitive member are transferred to the insulating layer of transfer paper, then developed, and fixed. Any of known developers, development processes, and fixing processes may be adopted, viz. there are no particular restrictions thereupon.

On the other hand, if the charge transport layer is formed from a hole-transporting material, its surface needs to be negatively charged. On image exposure of the photosensitive member after the negative charging, positive holes generated in the charge generation layer, in the exposed area, are injected into the charge transport layer, then arrive at the surface, and neutralize the negative charges, thus decaying the surface potential and producing an electrostatic contrast to the unexposed area. For developing the latent images, it is necessary to use a positive-working toner, contrary to the case where an electron-transporting material is used.

In another embodiment of this invention, the azulenium compound described above can be incorporated as a sensitizer into photosensitive films comprising an organic photoconductive material such as the above-cited hole-transporting material, e.g. hydrazones, pyrazolines, oxazoles, thiazoles, triarylmethanes, polyarylalkanes, triphenylamine, poly(N-vinylcarbazoles), or the like or an inorganic photoconductive material such as zinc oxide, cadmium sulfide, selenium, or the like. These photosensitive films are formed by a coating method from mixtures, containing the azulenium compounds, of the above photoconductive material and a binder.

Any photosensitive member of this invention contains at least one azulenium salt selected from the compounds represented by the general formula (I), (II), or (III) and if necessary, can be improved in sensitivity or made panchromatic by incorporating another photoconductive pigment or dye having a different absorption spectrum.

EXAMPLES 1-16

A solution of casein in aqueous ammonia (casein 11.2 g, 28% aq. ammonia 1 g, water 222 ml) was applied to aluminum sheets by means of a Meyer bar and dried to form an intermediate layer 1.0μ thick on each sheet.

16 kinds of coating dispersions were prepared by adding 5 g each of 16 kinds of azulenium salts shown in the following table to a solution of 2 g of a vinyl butyral resin (degree of butyral conversion 63 mole %) in 95 ml of isopropanol.

After dispersing in an attritor, the coating dispersions were applied separately onto the casein undercoat layers by means of a Meyer bar and dried to form charge generation layers each 0.1μ thick.

Then, a solution was prepared by dissolving 5 g of a hydrazone compound represented by the structural formula

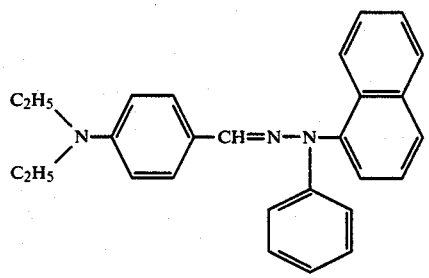

and 5 g of a poly(methyl methacrylate) resin (number average mol. wt. 100,000) in 70 ml of benzene. The solution was applied to the charge generation layers by means of a Meyer bar and dried to form charge transport layers each 12μ thick.

Thus prepared 16 kinds of electrophotographic photosensitive members were corona-charged at −5 KV in the static fashion by using an electrostatic copying paper testing machine (Model SP-428, mfd. by Kawaguchi Denki Co., Ltd), were retained for 10 seconds in the dark, and exposed to light at an intensity of 5 lux to examine their charging characteristics. The results are shown in Table 1, wherein Vo is the initial potential of the charged surface, Vk is the potential retention (%) after its decaying for 10 seconds in the dark, and $E\frac{1}{2}$ is the exposure quantity for halving the potential after decaying for 10 seconds in the dark.

TABLE 1

| Example No. | Azulenium salt (compound No.) | Vo (-V) | $V_K$ (%) | $E\frac{1}{2}$(lux · sec) |
|---|---|---|---|---|
| 1 | (1) | 540 | 86 | 8.5 |
| 2 | (3) | 490 | 89 | 10.4 |
| 3 | (6) | 570 | 90 | 15.7 |
| 4 | (9) | 560 | 92 | 13.4 |
| 5 | (13) | 580 | 85 | 7.4 |
| 6 | (14) | 600 | 84 | 25.0 |
| 7 | (16) | 590 | 92 | 16.5 |
| 8 | (17) | 570 | 91 | 21.5 |
| 9 | (20) | 580 | 87 | 5.6 |
| 10 | (23) | 560 | 85 | 4.0 |
| 11 | (25) | 550 | 81 | 10.5 |
| 12 | (29) | 590 | 80 | 11.4 |
| 13 | (30) | 520 | 86 | 16.7 |
| 14 | (33) | 575 | 84 | 3.8 |
| 15 | (38) | 600 | 80 | 15.4 |
| 16 | (44) | 570 | 86 | 10.2 |

EXAMPLE 17

A coating dispersion was prepared by dissolving 5 g of a polyester resin (Vylon 200, mfd. by Toyobo Co., Ltd.) and 5 g of 1-[pyridyl-(2)]-3-(4-N,N-diethylaminostyryl)-5-(4-N,N-diethylaminophenyl)pyrazoline in 80 ml of methyl ethyl ketone and dispersing 1.0 g of the azulenium salt compound No. (24) in the solution. The dispersion was applied to an aluminum layer vapor-deposited on a polyester film and was dried to prepare a photosensitive member having a photosensitive layer 13μ thick.

Charging characteristics of this photosensitive member were as follows:

Vo: −520 V
Vk: 87%
$E\frac{1}{2}$: 39.5 lux·sec

EXAMPLES 18-28

Photosensitive members were prepared in the same manner as in Example 17 except that the azulenium salt compounds shown in the following Table were used in place of the azulenium salt compound No. (24) employed in preparing a photosensitive member in Example 17. Charging characteristics of these photosensitive members are shown in Table 2.

TABLE 2

| Example No. | Azulenium salt (compound No.) | Vo (-V) | $V_K$ (%) | $E\frac{1}{2}$(lux · sec) |
|---|---|---|---|---|
| 18 | (2) | 530 | 80 | 45.7 |
| 19 | (7) | 560 | 84 | 57.2 |
| 20 | (12) | 470 | 75 | 37.2 |
| 21 | (15) | 510 | 85 | 46.5 |
| 22 | (19) | 530 | 82 | 78.0 |
| 23 | (23) | 540 | 84 | 34.6 |
| 24 | (24) | 520 | 87 | 37.0 |
| 25 | (31) | 490 | 83 | 42.5 |
| 25 | (33) | 540 | 86 | 26.5 |
| 27 | (40) | 510 | 84 | 65.0 |
| 28 | (43) | 550 | 80 | 86.0 |

EXAMPLE 29

A coating dispersion was prepared by adding 1 g of poly(N-vinylcarbazole) and 5 mg of the azulenium salt compound No. (5) to 10 g of 1,2-dichloroethane, followed by sufficient stirring. The dispersion was applied by doctor blade coating on an aluminum layer vapor-deposited on a poly(ethylene terephthalate) film and was dried to form an electrophotographic photosensitive layer 15μ thick.

Charging characteristics of the photosensitive sensitive member thus prepared were measured by the same manner as in Example 1. The results were as follows. (positive charging polarity):

Vo: +420 V
Vk: 84%
$E_{\frac{1}{2}}$: 34.5 lux·sec

EXAMPLE 30

An electrophotographic photosensitive member was prepared in the same manner as in Example 29 but using the azulenium salt compound No. (26) in place of No. (5). Charging characteristics of this photosensitive member were measured. The results were as follows. (positive charging polarity):

Vo: +450 V
Vk: 78%
$E_{\frac{1}{2}}$: 31.8 lux·sec

EXAMPLE 31

A coating dispersion was prepared by thoroughly mixing 10 g of finely divided zinc oxide (Sazex 2000, mfd. by Sakai chem. Ind. Co., Ltd.), 4 g of an acrylic resin (Dianal LR009, mfd. by Mitsubishi Rayon Co., Ltd.), 10 g of toluene, and 10 mg of the azulenium salt compound No. (23) in a ball mill. The dispersion was applied by doctor blade coating on an aluminum layer vapor-deposited on a poly(ethylene terephthalate) film and was dried to prepare an electrophotographic photosensitive member having a photosensitive layer 21μ thick.

The spectral sensitivity of this photosensitive member was measured with an electrophotographic spectrograph. The results indicated that this photosensitive layer is sensitive to rays of longer wavelengths as compared with the same zinc oxide layer but not containing such an azulenium salt compound.

EXAMPLE 32

A solution of casein in aqueous ammonia was applied to an 100-μ aluminum sheet and dried to form a 1.1-μ undercoat.

A charge-transfer complex was formed by dissolving 5 g of 2,4,7-trinitro-9-fluorenone and 5 g of poly(N-vinylcarbazole) (number-average mol. wt. 300,000) in 70 ml of tetrahydrofuran. This solution and 1 g of the azulenium salt compound No. (23) were added to a solution of 5 g of a polyester resin (Vylon, mfd. by Toyobo Co., Ltd.) in 70 ml of tetrahydrofuran to form a dispersion, which was applied to the undercoat and dried to form an electrophotographic photosensitive layer 12μ thick.

Charging characteristics of the photosensitive member thus prepared were measured in the same manner as in Example 1 but by positive charging. The results were as follows:

Vo: +520 V
Vk: 78%
$E_{\frac{1}{2}}$: 9.5 lux·sec

EXAMPLE 33

A 1.1-μ poly(vinyl alcohol) film was formed on an aluminum layer vapor-deposited on a poly(ethylene terephthalate) film.

A coating dispersion containing the azulenium salt compound as shown in Example 9 was applied onto the previously formed poly(vinyl alcohol) layer by means of a Meyer bar and dried to form a charge generation layer 0.1μ thick.

A solution prepared by dissolving 5 g of a pyrazoline compound represented by the formula

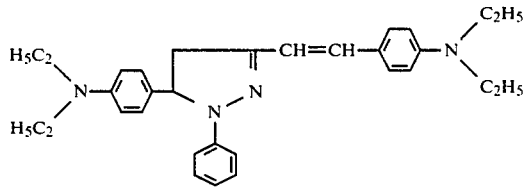

and 5 g of a polyarylate resin (product of polycondensation of bisphenol A and a terephthalic acidisophthalic acid mixture) in 70 ml of tetrahydrofuran was applied to the charge generation layer and dried to form a charge transport layer 10μ thick.

Charging characteristics of the photosensitive member thus prepared were measured by the same manner as in Example 1. The results were as follows.

Vo: −570 V
Vk: 84%
$E_{\frac{1}{2}}$: 6.7 lux·sec

EXAMPLE 34

A solution of casein in aqueous ammonia (casein 11.2 g, 28% aqueous ammonia 1 g, water 222 ml) was applied to an aluminum cylinder by a dip coating method and dried to form an undercoat layer of 1.0 g/m$^2$.

1 wt. part of the azulenium salt compound No. (37), 1 wt. part of a butyral resin (S-lec BM-2, mfd. by Sekisui Chem. Co., Ltd.), and 30 wt. parts of isopropyl alcohol were dispersed in a ball mill for 4 hours. The dispersion was applied to the previously formed undercoat by the dip coating method and dried to form a charge generation layer 0.3μ thick.

A solution was prepared by dissolving 1 wt. part of p-diethylaminobenzaldehyde-N-phenyl-N-α-naphthylhydrazone and 1 wt. part of a polysulfone resin (P 1700, mfd. by Union Carbide Corp.) in 6 wt. parts of monochlorobenzene with stirring. The solution was applied to the charge generation layer by the dip coating method and dried to form a charge transport layer 12μ thick.

The photosensitive member thus prepared was subjected to a corona discharge of −5 kV and the surface potential was measured (an initial potential Vo). Further, this photosensitive member is permitted to stand for 5 in the dark place and the surface potential was measured (a dark decay Vk). The sensitivity was evaluated by measuring the exposure quantity for halving the potential Vk after the dark decay ($E_{\frac{1}{2}}$ microjoule/cm$^2$). In this case, a gallium-aluminum-arsenic semiconductor laser (oscillation wavelength 780 nm) was used as the light source. The results were as follows.

Vo: −540 V
Vk: 84%
$E_{\frac{1}{2}}$: 1.5 microjoule/cm$^2$

EXAMPLES 35–43

Photosensitive members were prepared in the same manner as in Example 33 except that the compounds shown in Table 3 were used in place of the azulenium salt compound No. (37) employed in preparing a photosensitive member in Example 33. Characteristics of these photosensitive member are shown in Table 3.

TABLE 3

| Example No. | Azulenium salt (compound No.) | Vo (-V) | $V_K$ (%) | $E_{\frac{1}{2}}$ (microjoule/ $cm^2$) |
|---|---|---|---|---|
| 35 | (1) | 620 | 82 | 3.1 |
| 36 | (11) | 570 | 80 | 2.7 |
| 37 | (13) | 540 | 76 | 4.5 |
| 38 | (18) | 580 | 87 | 9.4 |
| 39 | (22) | 520 | 84 | 3.2 |
| 40 | (28) | 560 | 89 | 4.0 |
| 41 | (32) | 530 | 80 | 6.4 |
| 42 | (36) | 570 | 83 | 2.0 |
| 43 | (43) | 580 | 81 | 10.5 |

What is claimed is:

1. A photoconductive film which comprises the azulenium salt compound represented by the formula (I), (II) or (III) as shown below;

(I)

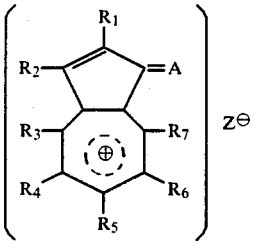

(II)

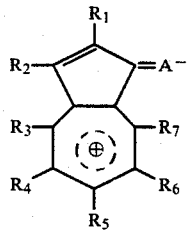

(III)

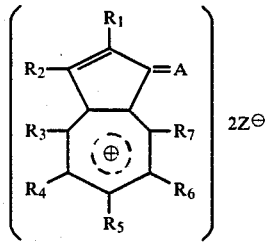

wherein each of $R_1$, $R_2$, $R_3$, $R_4$, $R_5$, $R_6$, and $R_7$ is hydrogen, halogen, or an organic monovalent residue, and at least one of the combinations ($R_1$ and $R_2$), ($R_2$ and $R_3$), ($R_3$ and $R_4$), ($R_4$ and $R_5$), ($R_5$ and $R_6$), and ($R_6$ and $R_7$) forms a substituted or unsubstituted heterocyclic ring or aliphatic ring; at least one of the combinations ($R_1$ and $R_2$), ($R_3$ and $R_4$), ($R_4$ and $R_5$), ($R_5$ and $R_6$), and ($R_6$ and $R_7$) may form a substituted or unsubstituted aromatic ring; A is an organic divalent residue linked with a double bond; $Z^{\ominus}$ is an anionic residue.

2. A photoconductive film according to claim 1, wherein the azulenium salt compounds are the compounds represented by the formulae (1)-(11) as shown below;

(1)

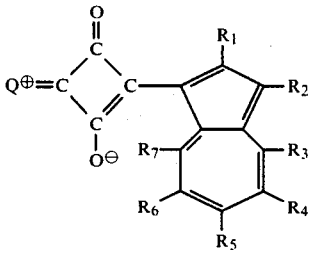

(2)

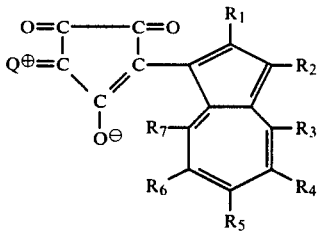

(3)

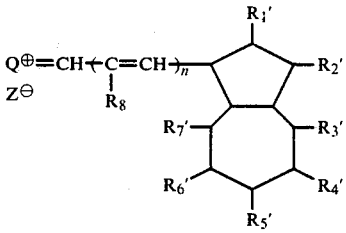

(4)

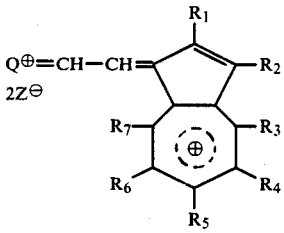

(5)

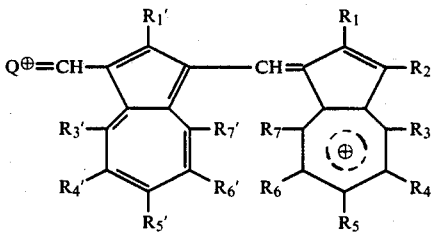

(6)

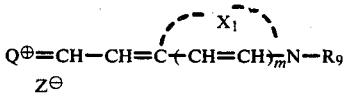

(7)

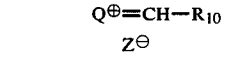

(8)

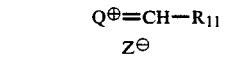

(9)

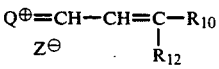

(10)

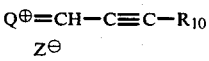

-continued

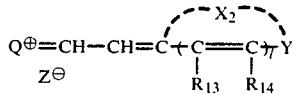

(11)

where in $Q^{\oplus}$ is

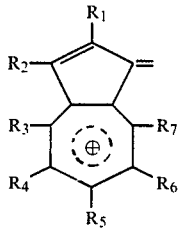

each of $R_1$, $R_2$, $R_3$, $R_4$, $R_5$, $R_6$, and $R_7$ is hydrogen, halogen, or an organic monovalent residue, and at least one of the combinations ($R_1$ and $R_2$) ($R_2$ and $R_3$), ($R_3$ and $R_4$), ($R_4$ and $R_5$), ($R_5$ and $R_6$), and ($R_6$ and $R_7$) forms substituted or unsubstituted heterocyclic ring or aliphatic ring; at least one of the combinations ($R_1$ and $R_2$), ($R_3$ and $R_4$), ($R_4$ and $R_5$), ($R_5$ and $R_6$), and ($R_6$ and $R_7$) may form a substituted or unsubstituted aromatic ring; A is an organic divalent residue linked with a double bond; each of $R_1'$, $R_2'$, $R_3'$, $R_4'$, $R_5'$, $R_6'$, and $R_7'$ is hydrogen, halogen, or an organic monovalent residue, and at least one of the combinations ($R_1'$ and $R_2'$), ($R_2'$ and $R_3'$), ($R_3'$ and $R_4'$), ($R_4'$ and $R_5'$), ($R_5'$ and $R_6'$), and ($R_6'$ and $R_7'$) may form a substituted or unsubstituted heterocyclic ring or aliphatic ring; at least one of the combinations ($R_1'$ and $R_2'$), ($R_3'$ and $R_4'$), ($R_4'$ and $R_5'$), ($R_5'$ and $R_6'$), and ($R_6'$ and $R_7'$) may form a substituted or unsubstituted aromatic ring;

$Z^{\ominus}$ is an anionic residue;

$R_8$ is hydrogen, nitro, cyano, alkyl, or aryl;

$R_9$ is substituted or unsubstituted alkyl, substituted or unsubstituted aryl, cycloakyl, alkenyl, or substituted or unsubstituted aralkyl;

$R_{10}$ is substituted or unsubstituted aryl;

$R_{11}$ is a monovalent heterocyclic group derived from a heterocyclic ring;

$R_{12}$ is hydrogen, alkyl, substituted or unsubstituted aryl;

$X_1$ is a nonmetal atomic group necessary to complete a nitrogen-containing heterocyclic ring;

$X_2$ is an atomic group necessary to complete pyran, thiapyran, selenapyran, benzopyran, benzothiapyran, benzoselenapyran, naphthopyran, naphthothiapyran, or naphthoselenapyran; Y is sulfur, oxygen, or selenium;

n is 0, 1, or 2;

m is 0 or 1; and each of $R_{13}$ and $R_{14}$ is hydrogen, alkyl, alkoxy, substituted or unsubstituted aryl, substituted or unsubstituted styryl, substituted or unsubstituted 4-phenyl-1,3-butadienyl or a substituted or unsubstituted heterocyclic group.

3. An electrophotographic photosensitive member which comprises an electroconductive substrate and a photoconductive film comprising the azulenium salt compound represented by the formula (I), (II), or (III) as shown below;

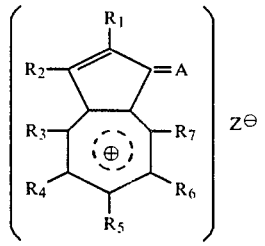

(I)

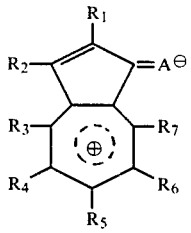

(II)

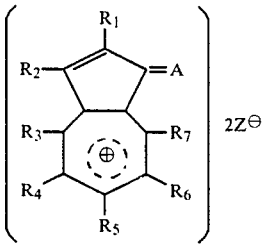

(III)

wherein each of $R_1$, $R_2$, $R_3$, $R_4$, $R_5$, $R_6$, and $R_7$ is hydrogen, halogen, or an organic monovalent residue, and at least one of the combinations ($R_1$ and $R_2$), ($R_2$ and $R_3$), ($R_3$ and $R_4$), ($R_4$ and $R_5$), ($R_5$ and $R_6$), and ($R_6$ and $R_7$) forms a substituted or unsubstituted heterocyclic ring or aliphatic ring. At least one of the combinations ($R_1$ and $R_2$), ($R_3$ and $R_4$), ($R_4$ and $R_5$), ($R_5$ and $R_6$), and ($R_6$ and $R_7$) may form a substituted or unsubstituted aromatic ring; A is an organic divalent residue linked with a double bond; $Z^{\ominus}$ is an anionic residue.

4. An electrophotographic photosensitive member according to claim 3, wherein the azulenium salt compounds are the compounds represented by the formulae (1)-(11) as shown below;

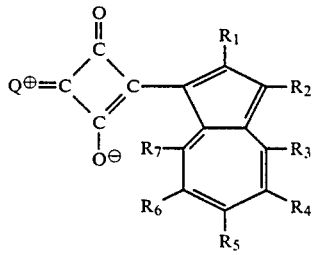

(1)

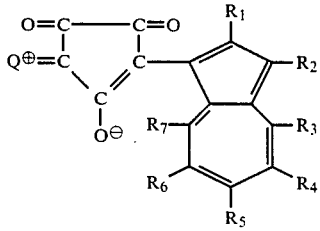

(2)

-continued (3)

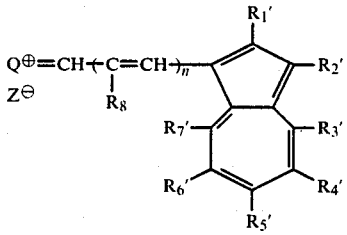

(4)

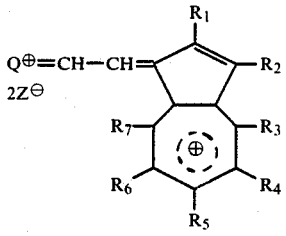

(5)

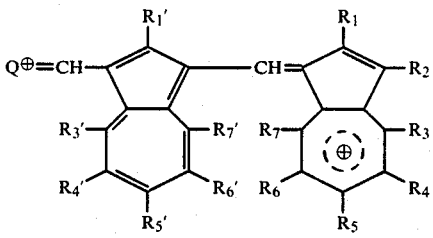

(6)

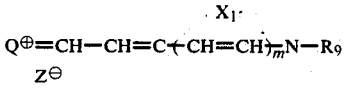

(7)

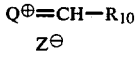

(8)

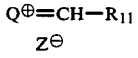

(9)

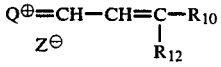

(10)

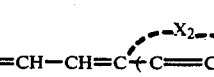

(11)

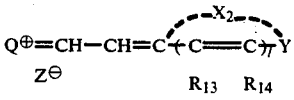

wherein $Q^{\oplus}$ is

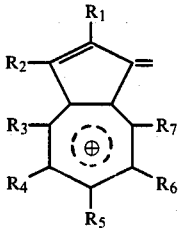

each of $R_1$, $R_2$, $R_3$, $R_4$, $R_5$, $R_6$, and $R_7$ is hydrogen, halogen, or an organic monovalent residue, and at least one of the combinations ($R_1$ and $R_2$), ($R_2$ and $R_3$), ($R_3$ and $R_4$), ($R_4$ and $R_5$), ($R_5$ and $R_6$), and ($R_6$ and $R_7$) forms a substituted or unsubstituted heterocyclic ring or aliphatic ring; at least one of the combinations ($R_1$ and $R_2$), ($R_3$ and $R_4$), ($R_4$ and $R_5$), ($R_5$ and $R_6$), and ($R_6$ and $R_7$) may form a substituted or unsubstituted aromatic ring; A is an organic divalent residue linked with a double bond; each of $R_1'$, $R_2'$, $R_3'$, $R_4'$, $R_5'$, $R_6'$, and $R_7'$ is hydrogen, halogen, or an organic monovalent residue, and at least one of the combinations ($R_1'$ and $R_2'$), ($R_2'$ and $R_3'$), ($R_3'$ and $R_4'$), ($R_4'$ and $R_5'$), ($R_5'$ and $R_6'$), and ($R_6'$ and $R_7'$) may form a substituted or unsubstituted heterocyclic ring or aliphatic ring; at least one of the combinations ($R_1'$ and $R_2'$), ($R_3'$ and $R_4'$), ($R_4'$ and $R_5'$), ($R_5'$ and $R_6'$), and ($R_6'$ and $R_7'$) may form a substituted or unsubstituted aromatic ring;

$Z^{\ominus}$ is an anionic residue;

$R_8$ is hydrogen, nitro, cyano, alkyl, or aryl;

$R_9$ is substituted or unsubstituted alkyl, substituted or unsubstituted aryl, cycloalkyl, alkenyl, or substituted or unsubstituted aralkyl;

$R_{10}$ is substituted or unsubstituted aryl;

$R_{11}$ is a monovalent heterocyclic group derived from a heterocyclic ring;

$R_{12}$ is hydrogen, alkyl, substituted or unsubstituted aryl;

$X_1$ is a nonmetal atomic group necessary to complete a nitrogen-containing heterocyclic ring;

$X_2$ is an atomic group necessary to complete pyran, thiapyran, selenapyran, benzopyran, benzothiapyran, benzoselenapyran, naphthopyran, naphthothiapyran, or naphthoselenapyran; Y is sulfur, oxygen, or selenium;

n is 0, 1, or 2;

m is 0 or 1; and each of $R_{13}$ and $R_{14}$ is hydrogen, alkyl, alkoxy, substituted or unsubstituted aryl, substituted or unsubstituted styryl, substituted or unsubstituted 4-phenyl-1,3-butadienyl or a substituted or unsubstituted heterocyclic group.

5. An electrophotographic photosensitive member according to claim 3, wherein the photoconductive film comprises at least one of the azulenium salt compound represented by the formula (I), (II), or (III), and a binder.

6. An electrophotographic photosensitive member according to claim 4, wherein the photoconductive film comprises at least one of the azulenium salt compounds represented by the formulae (1)-(11) and a binder.

7. An electrophotographic photosensitive member according to claim 3 in which the photoconductive film is used as a charge generation layer and a charge transport layer is provided.

8. An electrophotographic photosensitive member according to claim 7, wherein the charge generation layer is overlaid with the charge transport layer.

9. An electrophotographic photosensitive member according to claim 8, further comprising an intermediate layer between the charge generation layer and the electroconductive substrate.

10. An electrophotographic photosensitive member according to claim 7, wherein the charge generation layer comprises a hole-transporting material and a binder.

11. An electrophotographic photosensitive member according to claim 10, wherein the hole-transporting material is at least one compound selected from the group consisting of aromatic condensed ring compounds, hydrazones, pyrazolines, oxazoles, thiazoles, triaryl methanes, polyarylalkanes, polyphenylamines, and organic photoconductive polymers.

12. An electrophotographic photosensitive member according to claim 11, wherein the hole-transporting material is hydrazones.

13. An electrophotographic photosensitive member according to claim 3, wherein the photoconductive film contains the azulenium salt compound represented by the general formula (I), (II) or (III) as a sensitizer for a photoconductive material.

14. An electrophotographic photosensitive member according to claim 13, wherein the photoconductive material is at least one compound selected from the group consisting of aromatic condensed ring compounds, hydrazones, pyrazolines, oxazoles, thiazoles, triaryl methanes, polyarylalkanes, polyphenylamines, and organic photoconductive polymers.

15. An electrophotographic photosensitive member according to claim 13, wherein the photoconductive material is an inorganic photoconductive material.

16. An electrophotographic photosensitive member according to claim 3, wherein the photoconductive film is a vapor deposition film of at least one of the azulenium salt compounds represented by the formula (I), (II) or (III).

17. An electrophotographic photosensitive member according to claim 4, wherein the photoconductive film is a vapor deposition film of at least one of the azulenium salt compounds represented by the general formulae (1)-(11).

18. An electrophotographic photosensitive member according to claim 3, wherein a laser beam can be used as an exposure light source.

19. An electrophotographic photosensitive member according to claim 18, wherein the exposure light source is a semiconductor laser.

* * * * *

UNITED STATES PATENT AND TRADEMARK OFFICE

CERTIFICATE OF CORRECTION

PATENT NO. : 4,673,630

DATED : June 16, 1987

INVENTOR(S) : KAZUHARA KATAGIRI, ET AL.

It is certified that error appears in the above-identified patent and that said Letters Patent is hereby corrected as shown below:

COLUMN 1

Line 18, "closes" should read --close--.
Line 18, "photosesitive" should read --photosensitive--.
Line 33, "advantageous" should read --advantageously--.
Line 37, "low power" should read --low-power--.
Line 60, "farther" should read --further--.

COLUMN 3

Line 41, "$R_7$ but in" should read --$R_7$ when not--.

COLUMN 5

Lines 15-16, "$R_7$ but in" should read --$R_7$ when not--.

Line 56, "$R_4'$-$R_5'$.$R_5'$-$F_6'$," should read

--$R_4'$-$R_5'$, $R_5'$-$F_6'$,--.

COLUMN 6

Line 28, --General formula (6):-- should be inserted.

COLUMN 7

Line 19, "$Z^{\oplus}$" should read --$Z^{\ominus}$--.

UNITED STATES PATENT AND TRADEMARK OFFICE

CERTIFICATE OF CORRECTION

PATENT NO. : 4,673,630

DATED : June 16, 1987

INVENTOR(S) : KAZUHARA KATAGIRI, ET AL.

It is certified that error appears in the above-identified patent and that said Letters Patent is hereby corrected as shown below:

COLUMN 7

Lines 22-24, "$Q^{\oplus}$ =CH-CH=C-$R_{10}$"
$Z^{\ominus}$ $R_{12}$ should read --$Q^{\oplus}$ =CH-CH=C-$R_{10}$--.
$Z^{\ominus}$ $R_{12}$

COLUMN 11

Lines 12-13, " $CH_3$ " should read -- $CH_3$ --.

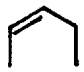

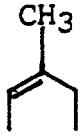

COLUMN 13

Line 30, --(30)-- should be inserted.

COLUMN 16

Line 49, "appropre-" should read --appropri- --.
Line 55, "appropreate" should read --appropriate--.
Line 58, "appropreate" should read --appropriate--.
Line 61, "appropreate" should read --appropriate--.
Line 67, "appropreate" should read --appropriate--.

UNITED STATES PATENT AND TRADEMARK OFFICE

CERTIFICATE OF CORRECTION

PATENT NO. : 4,673,630

DATED : June 16, 1987

INVENTOR(S) : KAZUHARA KATAGIRI, ET AL.

It is certified that error appears in the above-identified patent and that said Letters Patent is hereby corrected as shown below:

COLUMN 17

Line 3, "appropreate" should read --appropriate--.
Line 8, "appropreate" should read --appropriate--.
Line 13, "appropreate" should read --appropriate--.
Line 17, "appropreate" should read --appropriate--.
Line 23, "appropreate" should read --appropriate--.
Line 32, "previousy" should read --previously--.
Line 41, "mixed" should read --mixing--.

COLUMN 20

Line 35, "the" should be deleted.

COLUMN 22

Line 54-55, "25" should read --25--.
25 26

COLUMN 23

Line 1, "sensi-" should be deleted.
Line 2, "tive" should be deleted.

COLUMN 24

Line 15, "acidisophthalic" should read --acid-isophthalic--.
Line 51, "5 in" should read --5 seconds in--.
Line 68, "member" should read --members--.

UNITED STATES PATENT AND TRADEMARK OFFICE

CERTIFICATE OF CORRECTION

PATENT NO. : 4,673,630

DATED : June 16, 1987

INVENTOR(S) : KAZUHARA KATAGIRI, ET AL.

It is certified that error appears in the above-identified patent and that said Letters Patent is hereby corrected as shown below:

COLUMN 25

Line 34, "$=A^{-}$" should read --$=A^{\ominus}$--.

COLUMN 26

Lines 22-31, " 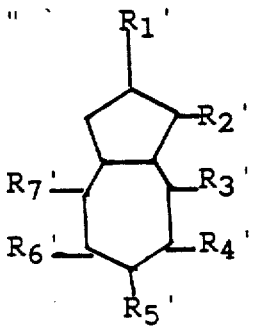 " should read -- 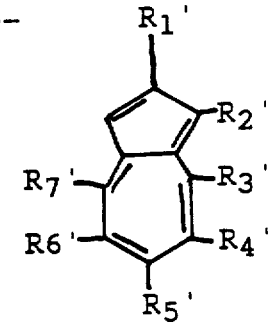 --.

COLUMN 27

Line 24, "substituted" should read --a substituted--.

COLUMN 29

Lines 32-33, " $X_1$ $C\text{-}(CH{=}CH)_m N\text{-}R_9$ "

should read

-- 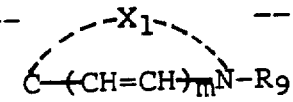 --.

UNITED STATES PATENT AND TRADEMARK OFFICE

CERTIFICATE OF CORRECTION

PATENT NO. : 4,673,630

DATED : June 16, 1987

INVENTOR(S) : KAZUHARA KATAGIRI, ET AL.

It is certified that error appears in the above-identified patent and that said Letters Patent is hereby corrected as shown below:

COLUMN 29

Lines 49-52, " 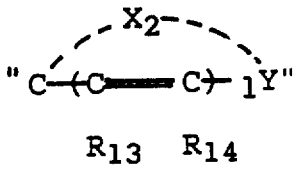 " should read -- 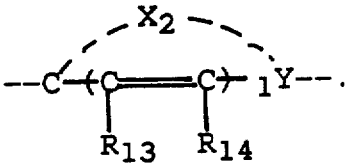 --.

COLUMN 30

Line 42, "compound" should read --compounds--.

Signed and Sealed this

Twenty-second Day of December, 1987

*Attest:*

DONALD J. QUIGG

*Attesting Officer*

*Commissioner of Patents and Trademarks*